US011127382B1

(12) United States Patent
Ruggles

(10) Patent No.: US 11,127,382 B1
(45) Date of Patent: Sep. 21, 2021

(54) TONE-ALTERING APPARATUS AND METHOD FOR MUSICAL WIND INSTRUMENTS

(71) Applicant: Richard Ruggles, Davie, FL (US)

(72) Inventor: Richard Ruggles, Davie, FL (US)

( * ) Notice: Subject to any disclaimer, the term of this patent is extended or adjusted under 35 U.S.C. 154(b) by 0 days.

(21) Appl. No.: 17/346,664

(22) Filed: Jun. 14, 2021

Related U.S. Application Data

(60) Provisional application No. 62/705,155, filed on Jun. 13, 2020.

(51) Int. Cl.
*G10D 9/10* (2020.01)
*G10D 7/03* (2020.01)

(52) U.S. Cl.
CPC ..... *G10D 9/10* (2020.02); *G10D 7/03* (2020.02)

(58) Field of Classification Search
CPC ..... G10D 9/10; G10D 7/03
See application file for complete search history.

(56) References Cited

U.S. PATENT DOCUMENTS 2,226,536 A * 12/1940 Seimer ..... G10D 9/047 84/382
2,883,898 A * 4/1959 Edward ..... G10D 7/03 84/384
4,714,001 A * 12/1987 Kergomard ..... G10D 9/01 84/386
5,241,890 A * 9/1993 Galper ..... G10D 9/00 84/380 R
6,852,917 B2 2/2005 McAleenan
7,385,134 B2 6/2008 Sawada et al.
7,799,980 B1 9/2010 Register
8,314,318 B2 11/2012 Brockman
8,334,447 B2 12/2012 Masuda et al.
9,311,904 B2 4/2016 Nakajima
10,199,017 B2 2/2019 Suenaga

FOREIGN PATENT DOCUMENTS

EP 1388843 A2 * 2/2004 ..... G10D 9/047
EP 1388843 B1 10/2012

* cited by examiner

*Primary Examiner* — Robert W Horn
(74) *Attorney, Agent, or Firm* — Mark C. Johnson; Johnson Dalal

(57) ABSTRACT

A tone-altering apparatus and method for musical wind instruments wherein the apparatus, used in combination with a musical wind instrument, comprises a chimney member with an upper chimney surface defining an upper enclosed aperture, with a chimney sidewall extending through one of a plurality of tone holes and defining a tone-altering channel, and with a lower chimney surface defining a lower enclosed aperture, the lower enclosed aperture and the upper enclosed aperture separating the tone-altering channel. The method of ergonomic altering the tone within a musical wind instrument comprises the steps of providing a musical wind instrument, providing a simulated tone hole generating a simulated tonal frequency, and affixing the chimney member to the barrel of the musical wind instrument to generate a chimney tonal frequency substantially equal to the simulated tonal frequency and provide a chimney member length less than the simulated tone hole length.

12 Claims, 4 Drawing Sheets

TONE-ALTERING APPARATUS AND METHOD FOR MUSICAL WIND INSTRUMENTS

FIELD OF THE INVENTION

The present invention relates generally to musical wind instruments, and, more particularly, relates to structures implemented on musical wind instruments to modulate the pitch frequency.

BACKGROUND OF THE INVENTION

In operating a musical wind instrument, a user generally achieves a desired tone or pitch by selectively covering any combination of tone holes disposed on the musical wind instrument, wherein each tone hole produces a different tone or pitch. By using one's finger to completely cover a tone hole, a user can achieve the desired tone or pitch and generate a melody or musical composition. Limitations of existing musical wind instruments, however, include the spacing of the tone holes in proximity to the entrance aperture of the instrument, i.e., the aperture operably configured to receive a user's lips.

When a sound wave resonates it repetitively travels back and forth between two reflectors. The frequency or pitch of the sound heard is a function of its velocity and the distance between these reflectors. Sound reflects against solid objects but oddly enough also reflects at the open end of a flute called the foot, at open tone holes, and at the opening of the mouthpiece. The mouthpiece at the head is a reflector and source of energy to keep the reverberation going and the foot is the other reflector. This head-to-foot sound is the base note, or the key of the instrument, when all the tone holes are closed. As the player lifts his fingers from the bottom hole first and then progressively up to the top tone hole the scale is played. Sound can travel through a tube, be it straight, curved, or any irregular shape and maintains a relatively constant velocity. For some low-pitched wind instruments like the tuba, the resonate length may be about 5.5 meters or 18 feet long, so the tube is looped around to keep the instrument easy to handle. So if an additional fold, loop or other device can be added to the sound path, the instrument can be made smaller or shortened.

Further, tone holes are often spaced so far away from each other that a user with small, short, or otherwise compromised fingers may not be able to reach those tone holes. Failure to completely cover a desired tone hole results in a failure to produce the desired tone or pitch and compromises the acoustic integrity of the entire musical composition. This limitation has inspired the creation of different improvements designed to simulate the pitch frequency generated by tone holes located furthest away from each other, but such improvements nevertheless feature their own limitations and shortcomings. Some existing prior art must be continually adjusted to achieve the desired pitch frequency whereas other prior art involves a reconfiguration of the entire musical wind instrument, itself. See, e.g., Brockman (University of Washington), U.S. Pat. No. 8,314,318 B2 (Nov. 20, 2012); Suenaga (Yamaha Corporation), U.S. Pat. No. 10,199,017 B2 (Feb. 5, 2019). Structural extension keys, meanwhile, are not always effective at completely covering the tone holes, involve an added expense, and create added weight which makes handling the musical wind instrument more difficult and cumbersome.

Therefore, a need exists to overcome the problems with the prior art as discussed above.

SUMMARY OF THE INVENTION

The invention provides a tone-altering apparatus and method for musical wind instruments that overcomes the hereinafore-mentioned disadvantages of the heretofore-known devices and methods of this general type and that enables a user to beneficially and selectively generate a chimney tonal frequency, through the tone-altering apparatus, that is substantially equal to the simulated tone frequency of a tone hole disposed on the musical wind instrument. In other words, the tone-altering apparatus and method achieves a substantially equal tone frequency without the need to configure the tone hole such a long distance away from each other. In turn, this improves the comfort and ease of handling and operating the musical wind instrument as the user is not forced to extend his or her fingers to reach a too distant hole. For musicians with small, short, or otherwise compromised fingers, the present invention enables them to successfully and comfortably handle a musical wind instrument. Further, the present invention enables the distance to a hole from the mouthpiece to be shortened by providing the needed additional distance inside the device with the insertion of this present invention, i.e., an added path length to the sound wave.

With the foregoing and other objects in view, there is provided, in accordance with the invention and in combination with a musical wind instrument having a mouthpiece defining an entrance aperture, having a barrel defining a plurality of tone holes, an inner barrel surface defining a barrel bore, and an outer barrel surface opposing the inner barrel surface, having a foot portion defining an outlet aperture fluidly coupled to the barrel bore and the entrance aperture, and having an instrument length separating the entrance aperture and the outlet aperture, a tone-altering apparatus comprising a chimney member affixedly coupled to the barrel, with an upper chimney surface defining an upper enclosed aperture, with a chimney sidewall extending through one of the plurality of tone holes, only partially within the barrel bore, and defining a tone-altering channel, with a lower chimney surface disposed in the barrel bore, defining a lower enclosed aperture, and disposed an offset length from the inner barrel surface, the lower enclosed aperture and the upper enclosed aperture separating the tone-altering channel.

In accordance with a further feature of the present invention, an embodiment of the present invention includes the barrel having a simulated tone hole generating a simulated tonal frequency disposed a simulated tone hole length away from the entrance aperture and the upper enclosed aperture of the chimney member being disposed a chimney member length away from the entrance aperture, wherein the tone-altering channel generates a chimney tonal frequency substantially equal to the simulated tonal frequency and the chimney member length is less than the simulated tone hole length. Thus instead of the sound wave needing to travel farther down the barrel to achieve the wavelength necessary this device includes this distance in a vertical orientation.

In accordance with a further feature of the present invention, the chimney member length is at least 20 mm less than the simulated tone hole length.

In accordance with a further feature of the present invention, the chimney sidewall and the tone-altering channel are disposed at a perpendicular configuration and orientation with respect to the inner barrel surface and a defined axis of airflow within the barrel bore.

In accordance with a further feature of the present invention, an embodiment of the present invention includes an overall chimney height separating the lower chimney surface and the upper chimney surface, wherein the overall chimney height is within a range of 5-20 mm.

In accordance with another feature of the present invention, the chimney sidewall is disposed at a perpendicular configuration with respect to the inner barrel surface and the tone-altering channel is a uniform diameter spanning the overall chimney height.

In accordance with another feature, an embodiment of the present invention also includes a flanged head may be affixedly coupled to the outer barrel surface and defining the upper chimney surface.

In accordance a feature of one embodiment of the present invention, the chimney sidewall is disposed at a perpendicular configuration with respect to the inner barrel surface.

In accordance with yet another feature, an embodiment of the present invention includes the tone-altering channel disposed at a perpendicular orientation with respect to a defined axis of a within the barrel bore.

In accordance with another feature, the chimney member is affixedly coupled to the barrel with an adhesive material, or molded in as one piece with the barrel.

In accordance with a further feature, an embodiment of the present invention also includes the musical wind instrument without any structural extension keys coupled thereto and covering any of the plurality of tone holes.

In accordance with the present invention, a method of ergonomic altering the tone within a musical wind instrument comprising the steps of providing a musical wind instrument having a mouthpiece defining an entrance aperture, having a barrel defining a plurality of tone holes, an inner barrel surface defining a barrel bore, and an outer barrel surface opposing the inner barrel surface, having a foot portion defining an outlet aperture fluidly coupled to the barrel bore and the entrance aperture, and having an instrument length separating the entrance aperture and the outlet aperture; providing a simulated tone hole generating a simulated tonal frequency disposed a simulated tone hole length away from the entrance aperture; and affixing a chimney member to the barrel, wherein the chimney member includes an upper chimney surface defining an upper enclosed aperture disposed a chimney member length away from the entrance aperture, a chimney sidewall extending through one of the plurality of tone holes, only partially within the barrel bore, and defining a tone-altering channel, a lower chimney surface disposed in the barrel bore, defining a lower enclosed aperture, and disposed an offset length from the inner barrel surface, the lower enclosed aperture and the upper enclosed aperture separating the tone-altering channel and the tone-altering channel generating a chimney tonal frequency substantially equal to the simulated tonal frequency and the chimney member length is less than the simulated tone hole length otherwise required without the device.

Although the invention is illustrated and described herein as embodied in a tone-altering apparatus and method for musical wind instruments, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the apparatus. Furthermore, there is no intention to be bound by any expressed or implied theory presented in the preceding technical field, background, brief summary or the following detailed description.

As used herein, the terms "about" or "approximately" apply to all dimensions and numeric values, whether or not explicitly indicated, that are referenced or specified in the claims and specifications. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the tone-altering apparatus.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
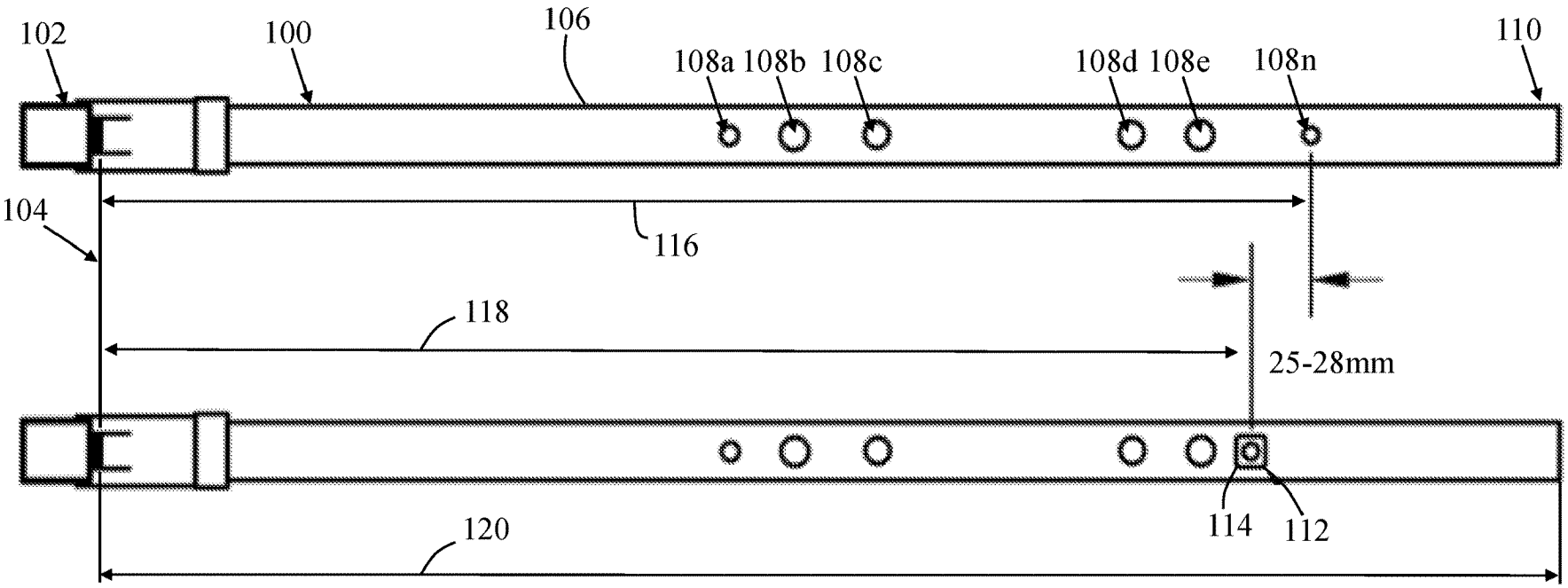
FIG. 1 depicts elevational top views of a tone-altering apparatus in combination with a musical wind instrument, in accordance with an exemplary embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient tone-altering apparatus and method of ergonomic altering the tone within a musical instrument. Embodiments of the invention provide musicians with compromised dexterity or relatively small or short fingers the ability to comfortably reach the tone-altering apparatus and completely cover the same so as to produce a pitch and tonal frequency substantially equal to the pitch and tonal frequency produced by those pre-existing, conventional tonal holes disposed farthest away from each other.

Figure 2:
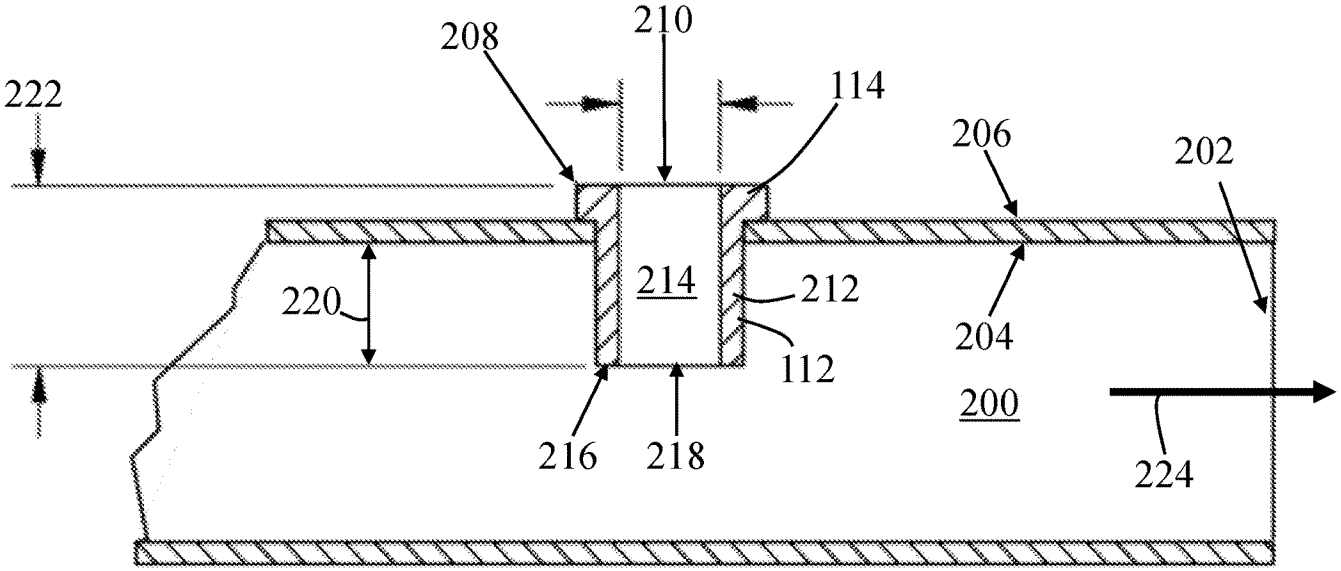
FIG. 2 is an elevational, fragmentary side view of an exemplary tone-altering apparatus in combination with a musical wind instrument, in accordance with the present invention.

Referring now to FIG. 1, one embodiment of the present invention is shown in an elevational top view. FIG. 1 shows several advantageous features of the present invention, but, as will be described below, the invention can be provided in several shapes, sizes, combinations of features and components, and varying numbers and functions of the components. The first example of a tone-altering apparatus, as shown in FIGS. 1-2, is used in combination with a musical wind instrument 100 having a mouthpiece 102 defining an entrance aperture 104, having a barrel 106 defining a plurality of tone holes 108*a-n*, an inner barrel surface 204 defining a barrel bore 200, and an outer barrel surface 206 opposing the inner barrel surface 204, having a foot portion 110 defining an outlet aperture 202 fluidly coupled to the barrel bore 200 and the entrance aperture 104, and having an instrument length 120 separating the entrance aperture 104 and the outlet aperture 202.

For example, a simple flute has a total of six tone holes, usually arranged in two groups of three, e.g., the top three tone holes 108*a*, 108*b*, and 108*c* played with the left hand and tone holes 108*d*, 108*e* and 108*n* played with the right hand. The spacing between these two groups is not a problem as the two hands can accommodate a wide range of separation. The problem arises with the spacing between the holes in each group when it exceeds about 25 mm. This problem is most prominent with the lower three tone holes used with the fingers of the right hand. The top part of FIG. 1 shows this spacing problem with tone holes 108*e* to 108*n* which can often be 30 mm to 50 mm apart. As such, the flute would be difficult to play, and only players with large hands and good dexterity would be able to play this instrument. This is a common problem, for example, with the popular Low "D" Irish Flute. Flute design is a compromise of limitations and playability. The flute designer selects the tone hole locations based on the pitch of the notes used in the scale that is chosen. The instrument shown in FIG. 1 could represent a Low "D" Irish Flute. Note, however, that tone hole 108*n* is far from hole tone hole 108*e* and that its diameter is smaller. Each tone hole location is dictated by the pitch of the note which is in the scale that is chosen for the instrument. Using flute design mathematical equations or flute design software, the designer determines the location along the flute barrel 106 for the holes to be bored. The designer may vary the diameter of the tone holes, which allows the holes to be moved up or down and still remain in tune. However, there are limitations as to how large or small the tone hole diameters can be bored. Making a tone hole diameter larger will allow it to be moved down and still remain in tune. Conversely making a tone hole smaller will allow it to be moved up and stay in tune.

More specifically, the largest tone hole diameter must be able to be covered with the finger of a player and 12 mm generally is a good maximum size. The minimum tone hole diameter is typically one third the inside bore of the barrel 106. For a 21 mm inside bore diameter, the minimum hole diameter would be 21/3, or 7 mm. Tone hole 108*n* would represent that hole moved up to its limit. As shown in FIG. 1, the hole 108*n* is still too far away from hole 108*e* to be reached by most users' fingers. The use of the present invention adds a new option to flute designers, allowing hole 108*n* to be moved, for example, 25-28 mm farther up, solving the problem of an unreachable tone hole.

As used herein, the term musical wind instrument 100 is intended to be construed broadly to include any musical instrument that uses air as the primary vibrating medium for the production of sound. Conventional musical wind instruments 100 contain some type of resonator (usually a tube) in which a column of air is set into vibration by the player blowing into (or over) a mouthpiece set at or near the end of the resonator. The pitch of the vibration is determined by the length of the tube and by manual modifications of the effective length of the vibrating column of air. In the case of some musical wind instruments 100, sound is produced by blowing through a reed; others require buzzing into a metal mouthpiece, while yet others require the player to blow into a hole at an edge, which splits the air column and creates the sound. As such, the form, structure, and configuration of the mouthpiece 102 will also likely vary depending on the type and model of musical wind instrument 100, but may consist of, in exemplary embodiments, a reed, metal mouthpiece, or other comparable aperture designed to receive a user's lips. In an exemplary embodiment of the present invention, and as depicted in the accompanying figures, the musical wind instrument 100 is a flute but, in alternate embodiments, may be any woodwind instrument, e.g., recorder, flute, whistle, oboe, clarinet, saxophone, bassoon, etc., or any brass instrument, e.g., horn, trumpet, trombone, euphonium, tuba, etc.

The plurality of tone holes 108*a-n*, wherein "n" refers to any number greater than one, refers to the conventional tone holes used on the specific musical wind instrument 100 being used, along with the conventional location, structure, form, number, and distribution of the plurality of tone holes 108*a-n* on the musical wind instrument 100 with respect to that specific musical wind instrument 100. The conventional location, structure, form, number, and distribution of the plurality of tone holes 108*a-n* on the musical wind instrument 100 varies depending on the type and model of musical wind instrument 100 being used. Likewise, the composition of the barrel bore 200, the outer barrel surface 206, and the inner barrel surface 204 varies depending on the type and model of musical wind instrument 100 being used. In the case of a brass musical wind instrument 100, and in an exemplary embodiment of the present invention, the barrel bore 200, the outer barrel surface 206, and the inner barrel surface 204 may be of a brass composition consisting of copper and zinc. In the case of a woodwind musical instrument 100, and in an exemplary embodiment of the present invention, the barrel bore 200, the outer barrel surface 206, and the inner barrel surface 204 may be of a wood, brass, carbon fiber, silver, cane, gold, platinum, or ocarina composition, or of any combination of the foregoing materials. The device may be incorporated into the wind instrument via any molding process.

It should be understood that terms such as, "front," "rear," "side," top," "bottom," and the like are indicated from the reference point of a viewer viewing the musical wind instrument 100 from the entrance aperture 104. The instrument length 120 separates the entrance aperture 104 and the outlet aperture 202 and, in an exemplary embodiment, ranges between approximately 24 and 28 inches in length, though the instrument length 120 may fluctuate depending on the type and model of musical wind instrument 100 used.

Figure 5:
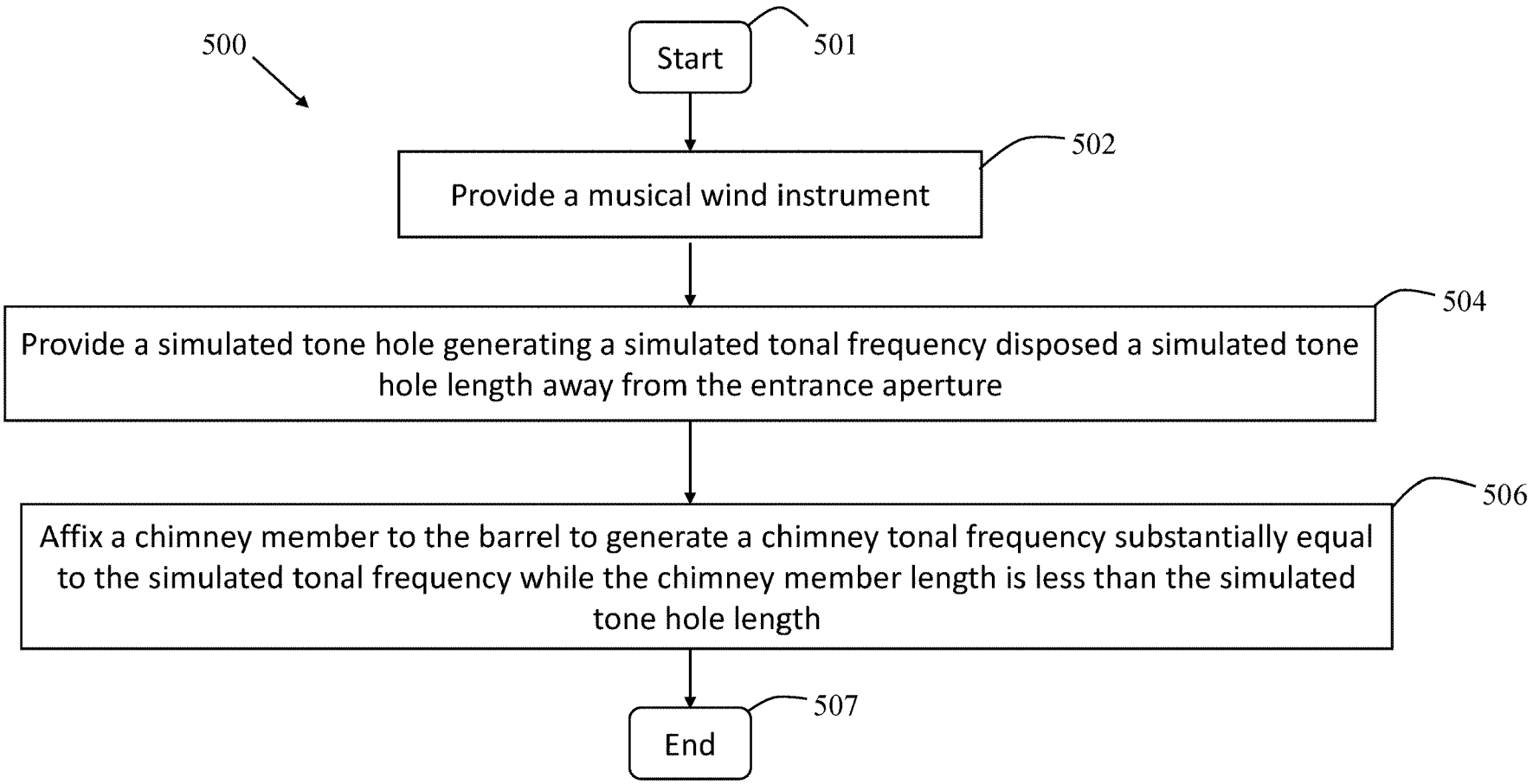
FIG. 5 is a process flow diagram depicting steps associated with a method of ergonomic altering the tone within a musical wind instrument, in accordance with one exemplary embodiment of the present invention.

FIG. 1 and FIG. 2 will be described in conjunction with the process flow chart of FIG. 5. Although FIG. 5 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 5 for the sake of brevity. In some embodiments, some or all of the process steps included in FIG. 5 can be combined into a single process.

Referring now to FIG. 1 and FIG. 2, the present improvement comprises a chimney member 112 affixedly coupled to the barrel 106 (wherein "affixedly" is defined as fastened, joined, or attached in a permanent or semi-permanent manner), with an upper chimney surface 208 defining an upper enclosed aperture 210, with a chimney sidewall 212 extending through one of the plurality of tone holes 108*a-n*, only partially within the barrel bore 200, and defining a tone-altering channel 214, with a lower chimney surface 216 disposed in the barrel bore 200, defining a lower enclosed aperture 218, and disposed an offset length 220 from the inner barrel surface 204, the lower enclosed aperture 218 and the upper enclosed aperture 210 separating the tone-altering channel 214. In various embodiments, the chimney member 112 may be of a polymeric, metal, or other comparable composition best suited for the musical wind instrument 100 used. The chimney member 112 is designed to serve as a pitch-modulating device that may be applied to the barrel 106 of any musical wind instrument 100. As used herein, pitch refers to the frequency of resonance within the barrel 106 of the musical wind instrument 100 when the upper enclosed aperture 210 of the tone-altering apparatus is uncovered while the musical wind instrument 100 is being played and all other tonal holes 108*a-n* are completely covered or closed. The chimney member 112 has the effect of lengthening the barrel 106 between where the chimney member 112 is positioned on the outer barrel surface 206 and the mouthpiece 102. To achieve correct tuning, the chimney member 112 must be placed farther up the barrel 106 of the musical wind instrument 100, thereby bringing the chimney member 112 closer to the adjacent tone hole 108*n*. The chimney member 112 may be used in place of one or more tone holes 108*a-n* such that any or all of the tone holes 108*a-n* may utilize or feature the chimney member 112.

In accordance with a further feature of the present invention, the barrel 106 has a simulated tone hole 108*n* generating a simulated tonal frequency disposed a simulated tone hole length 116 away from the entrance aperture 104. As described above, the simulated tone hole 108*a* refers to the conventional tone holes used on musical wind instruments 100. The simulated tonal frequency refers to the tonal frequency that is generally produced by conventional tone holes 108*a-n*. In combination with the foregoing, the upper enclosed aperture 210 of the chimney member 112 is disposed a chimney member length 118 away from the entrance aperture 104, wherein the tone-altering channel 214 generates a chimney tonal frequency substantially equal to the simulated tonal frequency and the chimney member length 118 is less than the simulated tone hole length 116. As used herein, the chimney tonal frequency is substantially equal to the simulated tonal frequency where there is approximately a 1% to 2% variance between the chimney tonal frequency and the simulated tonal frequency. Preliminary studies and experiments have yielded results indicating that the variance between the chimney tonal frequency and the simulated tonal frequency ranges approximately between 1% to 2%, demonstrating that the integrity of the pitch and tone frequency, and the musical composition as a whole, is not compromised by use of the chimney member 112 in place of the tone holes 108*a-n*.

In exemplary embodiments, the chimney member length 118 is at least 20 millimeters less than the simulated tone hole length 116. The chimney member length 118 and the simulated tone hole length 116 are measured from the entrance aperture 104 to the median diameter of each tone hole 108*a-n* (as shown in FIG. 1). In one embodiment, the chimney member length 118 is between approximately 25 millimeters and 28 millimeters less than the simulated tone hole length 116. The reduction reflected in the chimney member length 118 overcomes the limitations associated with existing prior art by reducing the distance between the tone holes 108*a-n* farthest away from the entrance aperture 104, which are replaced by the chimney member 112, and the entrance aperture 104. In other words, a user may more easily, comfortably, and readily reach the chimney member 112 to produce substantially the same tonal frequency as that traditionally produced by the tone holes 108*a-n*, placing the chimney member 112 within easy reach of the user's finger-span. With the present invention, designers of musical wind instruments 100 enjoy greater design flexibility and users of musical wind instruments 100 can eliminate the cost associated with purchasing structural extension keys and enjoy a more comfortable musical composition experience.

Figure 3:
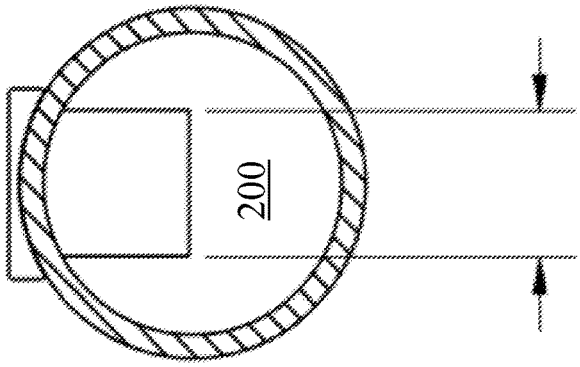
FIG. 3 is a top plan view of an exemplary tone-altering apparatus in combination with a musical wind instrument, in accordance with the present invention.
Figure 4:
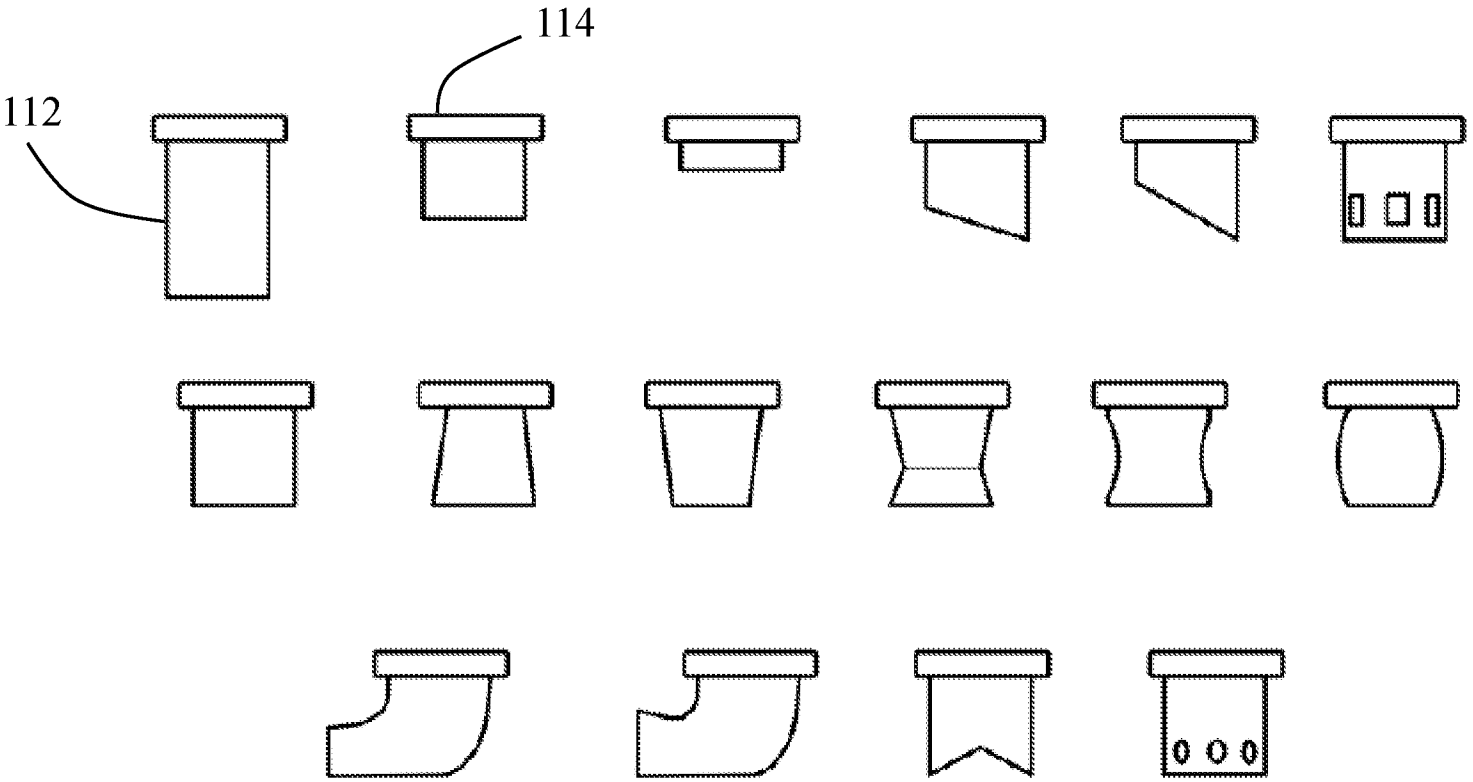
FIG. 4 depicts elevational side views of alternate embodiments of a tone-altering apparatus, in accordance with the present invention.

As best depicted in FIG. 2 and FIG. 3, the chimney member 112 is affixedly coupled to the barrel 106 to form an airtight seal between the chimney sidewall 212 and the barrel 106. In an exemplary embodiment, the chimney member 112 is affixedly coupled to the barrel 106 with an adhesive material such as, for example, and without limitation, cement, mucilage, glue, paste, or another comparable adhesive material. In alternate embodiments, the chimney member may be selectively removably coupled to the barrel 106 or, alternatively, built into the barrel 106 during the manufacturing process wherein it may be molded into the barrel 106 in a one-piece wind instrument design or assembled in separate and distinct sections. In accordance with alternate embodiments of the present invention, the chimney member 112 may be inserted in a flush configuration with the barrel 106. In accordance with a further feature, the chimney member 112 further comprises a flanged head 114 affixedly coupled to the outer barrel surface 206 and defining the upper chimney surface 208. The flanged head 114 provides additional structural support to the chimney member 112 to ensure the chimney member 112 remains in place on the barrel 106. As best depicted in FIG. 4, the chimney sidewall 212 may be of a variety of sizes and shapes and the offset length 220 and diameter of the tone-altering channel 214 may vary to obtain a desired tuning and sound quality. In an exemplary embodiment, the chimney sidewall 212 and the tone-altering channel 214 are disposed at a perpendicular configuration and orientation with respect to the inner barrel surface 204 and a defined axis of sound wave (best seen in FIG. 2 with arrow 224) within the barrel bore 200. This perpendicular configuration and orientation allows for ease of post-manufacturing coupling of the chimney member 112 onto the musical wind instrument 100 by a user and facilitates the pitch and tonal frequency generated by the tone-altering apparatus. In alternate embodiments, the chimney sidewall 212 is disposed at a perpendicular configuration with respect to the inner barrel surface 204.

In accordance with a further feature of the present invention, the chimney member 112 further comprises an overall chimney height 222 separating the lower chimney surface 216 and the upper chimney surface 208, wherein the overall chimney height 222 ranges between approximately 10 millimeters and 15 millimeters, or a sufficient and desired acoustic or sound quality. The overall chimney height 222 may be altered to obtain a desired tuning and sound quality and, in some embodiments, is accomplished during the manufacturing process or through a mechanism allowing for the selective modulation of the overall chimney height 222 by a user as desired. The overall chimney height 222 preferably does not exceed the height of the musical wind instrument 100 as such an excessive height negatively impacts the pitch and tonal frequency such that a chimney tonal frequency that is substantially equal to the simulated tonal frequency may be difficult or impossible to achieve. Further, an overall chimney height 222 in excess of 15 millimeters may cause the chimney sidewall 212 to protrude upward from the barrel 106, thereby making handling or operation of the musical wind instrument 100 more difficult or uncomfortable, making the musical wind instrument 100 heavier and more cumbersome, and impairing visibility of the user as a result of the protruding chimney sidewall 212.

Still referring to FIGS. 1-2, an exemplary dimensioning methodology of the tone holes 108*a-n* is described as follows. When a sound wave is coming from the mouthpiece 102 travels down the barrel 106 and meets the lower enclosed aperture 218, it may make a 90-degree turn going up to the upper enclosed aperture 210, then goes slightly above the upper enclosed aperture 210. Then, the sound wave makes a U-Turn and heads down to the lower enclosed aperture 218 again and makes another 90-degree turn and goes back towards the mouthpiece 102. This is the distance between the two reflectors, which is longer than the chimney member length 118 and is equivalent to the distance of the simulated tone hole length 116. The distance the sound wave travels is the same as the simulated tone hole length 118. The chimney member 112 may then be placed at about 50 cm down from the entrance aperture 104 or blow hole, the sound wave path distance added by the chimney member 112 is approximately: $D=2L+Id/2$, wherein D is the distance added to the sound path, L is the Length of the device tube overall, i.e., the overall chimney height 222, and the Id is the inside diameter of the chimney member 112. For example, for a chimney member 112 which is 11 mm long and has an 8 mm bore the added sound path is $D=2(11)+(8/2)=26$ mm.

In a preferred embodiment, the chimney sidewall 212 is disposed at a perpendicular configuration with respect to the inner barrel surface 204 and the tone-altering channel 214 is a uniform diameter spanning the overall chimney height 222, but may be tapered or shaped to achieve sound quality. A uniform diameter, or also a tapered or varied diameter, maintains the integrity of the pitch and tonal frequency. The diameter of the tone-altering channel 214 ranges between approximately 3 millimeters and 10 millimeters, and the thickness of the chimney sidewall 212 ranges between approximately 1 millimeter and 2 millimeters. In accordance with a preferred embodiment, the tone-altering channel 214 is disposed at a perpendicular orientation with respect to a defined axis of airflow within the barrel bore 200, but may also be at an angle for best sound quality. A perpendicular orientation or configuration allows for ease of post-manufacturing coupling of the chimney member 112 onto the musical wind instrument 100 by a user and facilitates the pitch and tonal frequency generated by the tone-altering apparatus to preserve the integrity of the chimney tonal frequency. In alternate embodiments, the chimney sidewall 212 is disposed at a perpendicular configuration with respect to the inner barrel surface 204.

In accordance with the present invention, the musical wind instrument 100 may be without any structural extension keys coupled thereto and covering any of the plurality of tone holes 108*a-n*. The functionality of the chimney member 112 eliminates the need for structural extension keys and any other coverings over the tone holes 108*a-n* which, when used in conjunction with the chimney member 112, would only serve to hamper and destroy the desired pitch and tone frequency.

As depicted in FIG. 5, a method 500 of ergonomic altering the tone within a musical wind instrument is also claimed comprising a first Step 502 of providing a musical wind instrument 100 having a mouthpiece 102 defining an entrance aperture 104, having a barrel 106 defining a plurality of tone holes 108*a-n*, an inner barrel surface 204 defining a barrel bore 200, and an outer barrel surface 206 opposing the inner barrel surface 204, having a foot portion 110 defining an outlet aperture 202 fluidly coupled to the barrel bore 200 and the entrance aperture 104, and having an instrument length separating the entrance aperture 104 and the outlet aperture 202; a next Step 504 of providing a simulated tone hole 108*n* generating a simulated tonal frequency disposed a simulated tone hole length 116 away from the entrance aperture 104; and a further Step 506 of affixing a chimney member 112 to the barrel 106, wherein the chimney member 112 includes an upper chimney surface 208 defining an upper enclosed aperture 210 disposed a chimney member length 118 away from the entrance aperture 104, a chimney sidewall 212 extending through one of the plurality of tone holes 108*a-n*, only partially within the barrel bore 200, and defining a tone-altering channel 214, a lower chimney surface 216 disposed in the barrel bore 200, defining a lower enclosed aperture 218, and disposed an offset length 220 from the inner barrel surface 204, the lower enclosed aperture 218 and the upper enclosed aperture 210 separating the tone-altering channel 214 and the tone-altering channel 214 generating a chimney tonal frequency substantially equal to the simulated tonal frequency and the chimney member length 118 is less than the simulated tone hole length 116.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above-described features.

What is claimed is:

1. In combination with a musical wind instrument having a mouthpiece defining an entrance aperture, having a barrel defining a plurality of tone holes, an inner barrel surface defining a barrel bore, and an outer barrel surface opposing the inner barrel surface, having a foot portion defining an outlet aperture fluidly coupled to the barrel bore and the entrance aperture, and having an instrument length separating the entrance aperture and the outlet aperture, the improvement comprising:

a chimney member affixedly coupled to the barrel, with an upper chimney surface defining an upper enclosed aperture, with a chimney sidewall extending through one of the plurality of tone holes, only partially within the barrel bore, and defining a tone-altering channel, with a lower chimney surface disposed in the barrel bore, defining a lower enclosed aperture, and disposed an offset length from the inner barrel surface, the lower enclosed aperture and the upper enclosed aperture separating the tone-altering channel.

2. The combination according to claim 1, the barrel having a simulated tone hole generating a simulated tonal frequency disposed a simulated tone hole length away from the entrance aperture, the improvement further comprising:

the upper enclosed aperture of the chimney member disposed a chimney member length away from the entrance aperture, wherein the tone-altering channel generates a chimney tonal frequency substantially equal to the simulated tonal frequency and the chimney member length is less than the simulated tone hole length.

3. The combination according to claim 2, wherein:

the chimney member length is at least 20 mm less than the simulated tone hole length.

4. The combination according to claim 3, wherein:

the chimney sidewall and the tone-altering channel are disposed at a perpendicular configuration and orientation with respect to the inner barrel surface and a defined axis of airflow within the barrel bore.

5. The combination according to claim 1, wherein the chimney member further comprises:

an overall chimney height separating the lower chimney surface and the upper chimney surface, wherein the overall chimney height is within a range of 10-15 mm.

6. The combination according to claim 5, wherein:

the chimney sidewall is disposed at a perpendicular configuration with respect to the inner barrel surface and the tone-altering channel is a uniform diameter spanning the overall chimney height.

7. The combination according to claim 1, wherein the chimney member further comprises:

a flanged head affixedly coupled to the outer barrel surface and defining the upper chimney surface.

8. The combination according to claim 7, wherein:

the chimney sidewall is disposed at a perpendicular configuration with respect to the inner barrel surface.

9. The combination according to claim 8, wherein:

the tone-altering channel is disposed at a perpendicular orientation with respect to a defined axis of airflow within the barrel bore.

10. The combination according to claim 7, wherein:

the chimney member is affixedly coupled to the barrel with an adhesive material.

11. The combination according to claim 1, wherein:

the musical wind instrument without any structural extension keys coupled thereto and covering any of the plurality of tone holes.

12. A method of ergonomic altering the tone within a musical wind instrument comprising the steps of:

providing a musical wind instrument having a mouthpiece defining an entrance aperture, having a barrel defining a plurality of tone holes, an inner barrel surface defining a barrel bore, and an outer barrel surface opposing the inner barrel surface, having a foot portion defining an outlet aperture fluidly coupled to the barrel bore and the entrance aperture, and having an instrument length separating the entrance aperture and the outlet aperture;

providing a simulated tone hole generating a simulated tonal frequency disposed a simulated tone hole length away from the entrance aperture; and affixing a chimney member to the barrel, wherein the chimney member includes an upper chimney surface defining an upper enclosed aperture disposed a chimney member length away from the entrance aperture, a chimney sidewall extending through one of the plurality of tone holes, only partially within the barrel bore, and defining a tone-altering channel, a lower chimney surface disposed in the barrel bore, defining a lower enclosed aperture, and disposed an offset length from the inner barrel surface, the lower enclosed aperture and the upper enclosed aperture separating the tone-altering channel and the tone-altering channel generating a chimney tonal frequency substantially equal to the simulated tonal frequency and the chimney member length is less than the simulated tone hole length.

* * * * *